US009204680B2

(12) United States Patent
Hoffer et al.

(10) Patent No.: US 9,204,680 B2
(45) Date of Patent: Dec. 8, 2015

(54) FOOTWEAR HAVING CORRESPONDING OUTSOLE AND MIDSOLE SHAPES

(75) Inventors: Kevin W. Hoffer, Portland, OR (US); John Hurd, Lake Oswego, OR (US); Benjamin A. Shaffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 545 days.

(21) Appl. No.: 13/300,298

(22) Filed: Nov. 18, 2011

(65) Prior Publication Data

US 2013/0125416 A1 May 23, 2013

(51) Int. Cl.

| | |
|---|---|
| ***A43B 1/10*** | (2006.01) |
| ***A43B 13/14*** | (2006.01) |
| ***A43B 7/06*** | (2006.01) |
| ***A43B 13/12*** | (2006.01) |
| ***A43B 1/00*** | (2006.01) |
| ***A43B 13/16*** | (2006.01) |
| ***A43B 13/18*** | (2006.01) |
| ***A43B 13/22*** | (2006.01) |

(52) U.S. Cl.

CPC ..... *A43B 1/0009* (2013.01); *A43B 1/0072* (2013.01); *A43B 13/122* (2013.01); *A43B 13/127* (2013.01); *A43B 13/16* (2013.01); *A43B 13/187* (2013.01); *A43B 13/22* (2013.01)

(58) Field of Classification Search

CPC .... A43B 13/12; A43B 13/122; A43B 13/125; A43B 13/127; A43B 13/141; A43B 13/145; A43B 13/16; A43B 13/42

USPC ..... 36/102, 3 B, 25 R, 30 A, 30 R, 31, 29

See application file for complete search history.

(56) References Cited

U.S. PATENT DOCUMENTS

| | | | | |
|---|---|---|---|---|
| 1,993,208 | A | | 3/1935 | Cohn |
| 2,527,414 | A | | 10/1950 | Hallgren |
| 4,041,618 | A | | 8/1977 | Famolare, Jr. |
| 4,223,456 | A | | 9/1980 | Cohen |
| 4,336,661 | A | | 6/1982 | Medrano |
| 4,402,146 | A | * | 9/1983 | Parracho et al. ..... 36/129 |
| 4,494,322 | A | | 1/1985 | Klagmann |
| 4,597,199 | A | | 7/1986 | Hong |
| 4,739,765 | A | | 4/1988 | Sydor et al. |
| 4,742,625 | A | | 5/1988 | Sydor et al. |
| 4,774,774 | A | | 10/1988 | Allen, Jr. |
| 4,837,948 | A | | 6/1989 | Cho |

(Continued)

FOREIGN PATENT DOCUMENTS

| | | | |
|---|---|---|---|
| CN | 101005773 | A | 7/2007 |
| CN | 101677651 | A | 3/2010 |

OTHER PUBLICATIONS

International Search Report and Written Opinion mailed Oct. 14, 2013 in International Application No. PCT/US2012/064921.

(Continued)

*Primary Examiner* — Robert J Hicks
*Assistant Examiner* — Cameron A Carter
(74) *Attorney, Agent, or Firm* — Plumsea Law Group, LLC

(57) ABSTRACT

An article of footwear includes first and second midsole layers and first and second outsole layers. The second midsole layer defines a plurality of bores. A first outsole layer is translucent. A second outsole layer includes a plurality of non-contiguous abrasion-resistant members that correspond in shape and size to one or more of the bores in the second midsole layer.

20 Claims, 11 Drawing Sheets

(56) References Cited

U.S. PATENT DOCUMENTS

| | | | | |
|---|---|---|---|---|
| 5,042,175 | A | 8/1991 | Ronen et al. | |
| 5,044,096 | A | 9/1991 | Polegato | |
| 5,152,081 | A | 10/1992 | Hallenbeck et al. | |
| 5,233,767 | A | 8/1993 | Kramer | |
| 5,282,288 | A | 2/1994 | Henson | |
| 5,402,588 | A | 4/1995 | Graham et al. | |
| 5,493,791 | A | 2/1996 | Kramer | |
| 5,572,804 | A | 11/1996 | Skaja et al. | |
| 5,718,063 | A * | 2/1998 | Yamashita et al. | 36/28 |
| 5,768,806 | A | 6/1998 | Parisotto | |
| 5,771,611 | A | 6/1998 | Chang | |
| 5,782,014 | A | 7/1998 | Peterson | |
| D398,145 | S | 9/1998 | Ganon | |
| 5,896,678 | A | 4/1999 | Ganon | |
| 5,983,529 | A * | 11/1999 | Serna | 36/28 |
| 6,266,896 | B1 | 7/2001 | Liu | |
| 6,330,757 | B1 * | 12/2001 | Russell | 36/28 |
| 6,367,172 | B2 | 4/2002 | Hernandez | |
| 6,408,544 | B1 | 6/2002 | Hernandez | |
| 6,560,900 | B2 | 5/2003 | Bray, Jr. et al. | |
| 6,564,476 | B1 * | 5/2003 | Hernandez | 36/28 |
| 6,666,157 | B1 | 12/2003 | Ganon | |
| 7,016,867 | B2 * | 3/2006 | Lyden | 705/26.5 |
| 7,118,793 | B2 | 10/2006 | Wang | |
| 7,134,223 | B2 | 11/2006 | Ganon | |
| 7,178,267 | B2 | 2/2007 | Skaja et al. | |
| 7,200,955 | B2 | 4/2007 | Foxen | |
| D553,835 | S | 10/2007 | McClaskie | |
| 7,284,341 | B2 | 10/2007 | Moseley | |
| 7,475,497 | B2 * | 1/2009 | Hoffer et al. | 36/28 |
| 7,549,236 | B2 * | 6/2009 | Dillon et al. | 36/30 R |
| 2003/0051372 | A1 * | 3/2003 | Lyden | 36/27 |
| 2003/0131501 | A1 | 7/2003 | Erickson et al. | |
| 2004/0006891 | A1 * | 1/2004 | Russell | 36/28 |
| 2005/0044745 | A1 * | 3/2005 | Pfander | 36/3 B |
| 2005/0268490 | A1 * | 12/2005 | Foxen | 36/28 |
| 2005/0268491 | A1 * | 12/2005 | McDonald et al. | 36/28 |
| 2007/0119075 | A1 * | 5/2007 | Schindler et al. | 36/29 |
| 2007/0209230 | A1 * | 9/2007 | Dillon et al. | 36/25 R |
| 2007/0220778 | A1 * | 9/2007 | Fusco et al. | 36/30 R |
| 2008/0250673 | A1 * | 10/2008 | Andrews et al. | 36/25 R |
| 2009/0282700 | A1 * | 11/2009 | Dillon et al. | 36/88 |
| 2009/0320330 | A1 * | 12/2009 | Borel et al. | 36/30 R |
| 2010/0146819 | A1 * | 6/2010 | Teteriatnikov et al. | 36/103 |
| 2010/0192415 | A1 * | 8/2010 | James | 36/103 |
| 2010/0307028 | A1 * | 12/2010 | Teteriatnikov et al. | 36/108 |
| 2011/0061265 | A1 * | 3/2011 | Lyden | 36/103 |
| 2011/0088281 | A1 * | 4/2011 | Farina et al. | 36/29 |
| 2011/0138652 | A1 * | 6/2011 | Lucas et al. | 36/28 |
| 2011/0162232 | A1 * | 7/2011 | Gazzara et al. | 36/29 |
| 2011/0179669 | A1 * | 7/2011 | Hanebrink et al. | 36/28 |
| 2011/0185590 | A1 * | 8/2011 | Nishiwaki et al. | 36/28 |
| 2011/0197470 | A1 * | 8/2011 | Caron et al. | 36/29 |
| 2011/0277349 | A1 * | 11/2011 | Kim | 36/84 |

OTHER PUBLICATIONS

International Preliminary Report on Patentability (including Written Opinion of the ISA) mailed May 30, 2014 in International Application No. PCT/US2012/064921.

First Office Action for Chinese Application No. CN201280056424.9, mailed on May 18, 2015, 8 pages.

US 4,974,345, 12/1990, Yung-Mao (withdrawn)

* cited by examiner

FOOTWEAR HAVING CORRESPONDING OUTSOLE AND MIDSOLE SHAPES

BACKGROUND

The present invention relates generally to footwear having a midsole with bores, an outsole with abrasion-resistant elements that correspond in shape and size to the bores, and a translucent member therebetween to allow a user to view the correspondence between the abrasion-resistant elements and the bores.

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces, the sole structure may provide traction, control foot motions (e.g., by resisting pronation), and impart stability, for example. Accordingly, the upper and the sole structure operate cooperatively to provide a comfortable structure that is suited for a wide variety of athletic activities.

The sole structure generally incorporates multiple layers that are conventionally referred to as a sockliner, a midsole, and an outsole. The sockliner is a thin, compressible member located within the upper and adjacent to a plantar (i.e., lower) surface of the foot to enhance footwear comfort. The midsole is conventionally secured to a lower surface of the upper and forms a middle layer of the sole structure that is primarily responsible for attenuating ground reaction forces. The outsole forms the ground-contacting element of the footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the wearer or of the activity for which the footwear is intended to be used.

In addition to polymer foam materials, conventional midsoles may include, for example, one or more fluid-filled chambers. In general, the fluid-filled chambers are formed from an elastomeric polymer material that is sealed and pressurized. The chambers are then encapsulated in the polymer foam of the midsole such that the combination of the chamber and the encapsulating polymer foam functions as the midsole of the sole structure. In some configurations, textile or foam tensile members may be located within the chamber or reinforcing structures may be bonded to an exterior or interior of the chamber to impart shape to the chamber.

Articles of athletic footwear are designed with a particular purpose in mind. Some articles of athletic footwear are designed to withstand jarring impact. Others are designed to withstand lateral impact. Some are designed to enhance stability. Others are designed to provide enhanced cushioning. The purpose for which a shoe will be used informs the design choices made by the designers.

Some patents disclose bores in a midsole. These include U.S. Pat. Nos. 1,993,208; 4,336,661; 4,041,618; 5,042,175; 5,282,288; and 7,475,497. Other patents show apertures extending from both the insole and the outsole towards a midsole. These include U.S. Pat. Nos. 5,572,804 and 7,200,955. However, these bores are typically not visible to the user. In most instances, the bores are hidden in the midsole and covered with an opaque material.

It is useful to have an article of footwear that includes a transparent or translucent layer that allows a user to see the bores and the shapes of the bores and to include a series of abrasion resistant members in corresponding shapes as an outsole.

SUMMARY

In one aspect, an embodiment may provide an article of footwear comprising an upper, an outsole, and a midsole interposed between and attached to both the upper and the outsole. The midsole may comprise a first midsole layer and a second midsole layer secured to one another. The first midsole layer may be adjacent the upper and the second midsole layer may be adjacent the outsole. The second midsole layer may define a plurality of bores. Each bore may have a shape.

The outsole may comprise a first outsole layer and a second outsole layer. The first outsole layer may be adjacent the midsole and may be substantially translucent. The second outsole layer may comprise at least two non-contiguous, abrasion-resistant members that may correspond in shape and size to at least one of the plurality of bores in the second midsole layer.

In another aspect, an embodiment may provide an article of footwear comprising an upper, an outsole, and a midsole interposed between and attached to both the upper and the outsole. The midsole may comprise a first midsole layer and a second midsole layer secured to one another. The first midsole layer may be adjacent the upper and the second midsole layer may be adjacent the outsole. The second midsole layer may define a plurality of bores. Each bore may have a shape.

The outsole may comprise a first outsole layer and a second outsole layer. The first outsole layer may be adjacent the midsole and may be substantially translucent. The first outsole layer may comprise at least two non-contiguous sections that correspond generally in shape and size to first and second subsets of the plurality of bores in the midsole. The second outsole layer may comprise at least two non-contiguous, abrasion-resistant members that correspond in shape and size to at least one of the plurality of bores in the midsole second layer. At least one abrasion-resistant member may be secured to each non-contiguous section of the first outsole layer.

In another aspect, an embodiment may provide an article of footwear comprising an upper, an outsole, and a midsole interposed between and attached to both the upper and the outsole. The midsole may comprise a first midsole layer and a second midsole layer secured to one another. The first midsole layer may be adjacent the upper and the second midsole layer may be adjacent the outsole. The second midsole layer may define a plurality of bores. Each bore may have a shape.

The outsole may comprise a first outsole layer and a second outsole layer. The first outsole layer may be adjacent the midsole. At least a portion of the first outsole layer may be substantially transparent. The second outsole layer may comprise a plurality of non-contiguous, abrasion-resistant members. The overall configuration of the abrasion-resistant members may correspond to the shape of an impact-absorbing portion of a foot.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The following discussion and accompanying figures disclose an article of footwear, particularly a sole structure of the footwear, and methods for manufacturing the sole structure. Concepts related to the sole structure are disclosed with reference to footwear having a configuration that is suitable for various sports and may be utilized with a wide range of athletic footwear styles, including running shoes, tennis shoes, football shoes, cross-training shoes, walking shoes, soccer shoes, and hiking boots, for example. The sole structure may also be utilized with footwear styles that are generally considered to be non-athletic, including dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

Figure 1:
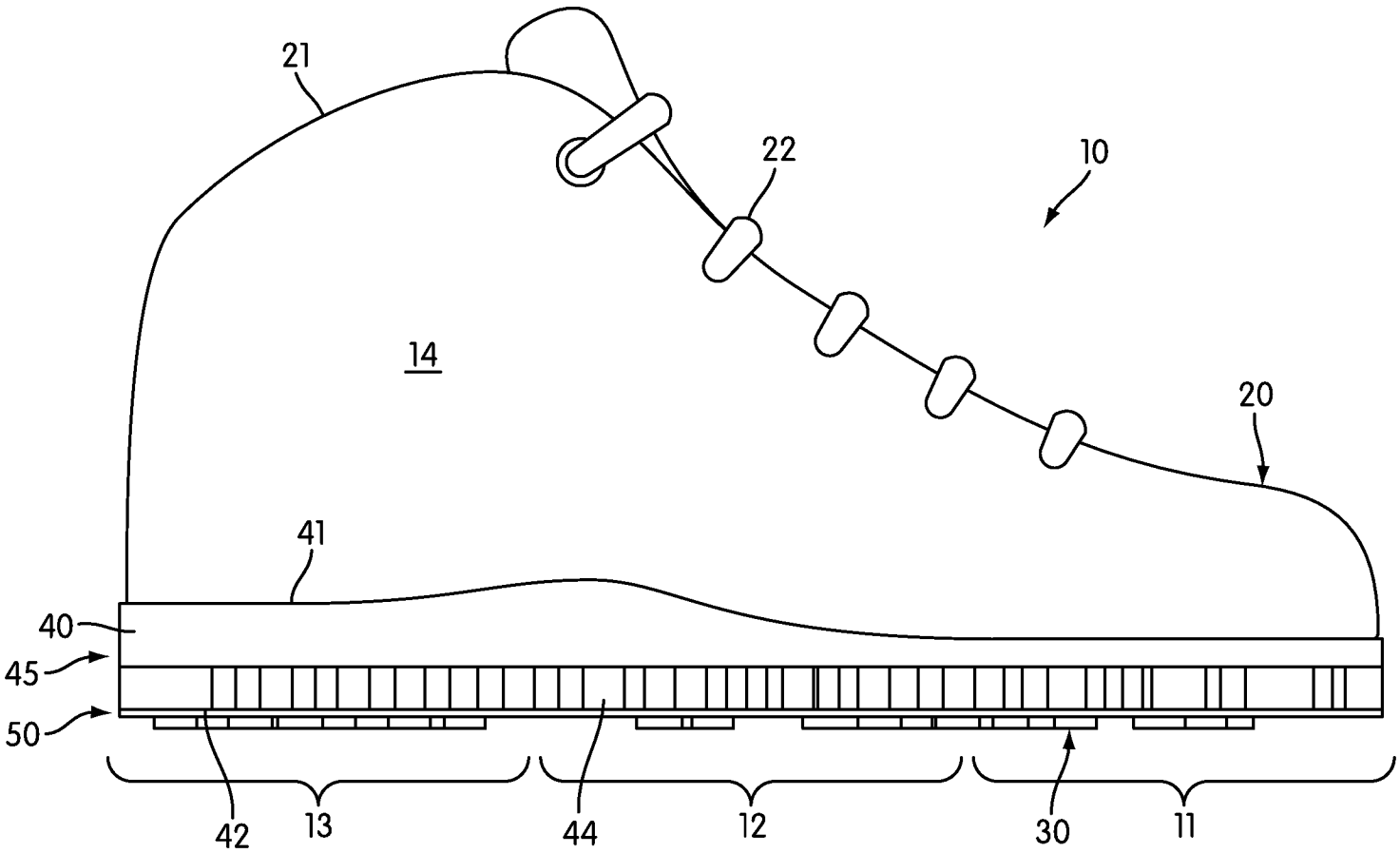
FIG. 1 is a lateral side elevational view of an article of footwear.
Figure 2:
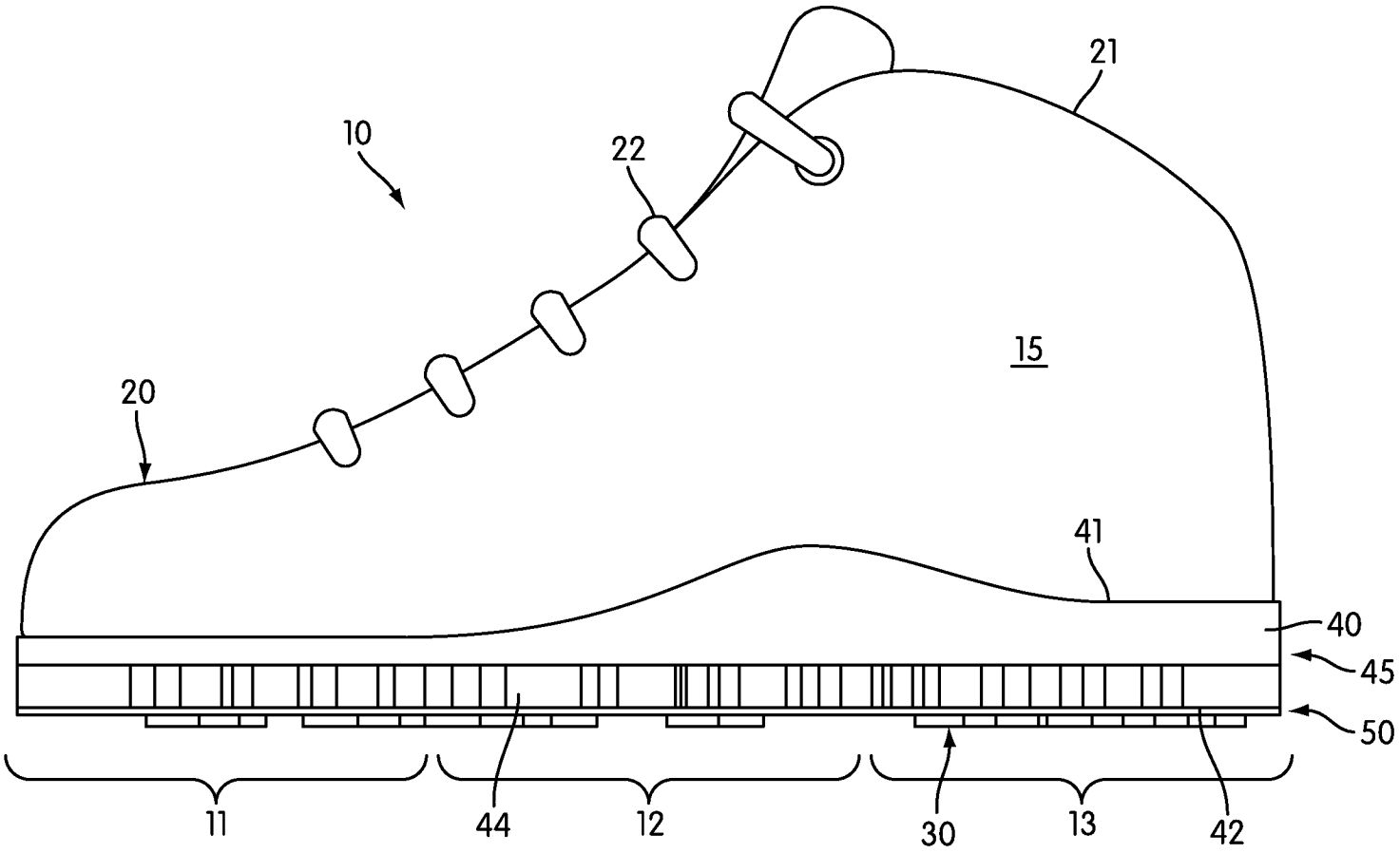
FIG. 2 is a medial side elevational view of the article of footwear.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13. Footwear 10 also includes a lateral side 14 and an opposite medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality of material elements (e.g., textiles, foam, leather, and synthetic leather) that are stitched or adhesively bonded together to form an interior void for securely and comfortably receiving a foot. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present application primarily relate to sole structure 30, upper 20 may exhibit the general configuration discussed above or the general configuration of practically any other conventional or non-conventional upper. Accordingly, the structure of upper 20 utilized with sole structure 30 or variants thereof may vary significantly within the scope of the present invention.

Sole structure 30, which is depicted generally separate from upper 20 in FIGS. 3-11, is secured to upper 20 and extends between upper 20 and the ground. The primary elements of sole structure 30 are a midsole 45 and an outsole 50. Midsole 45 is secured to a lower area of upper 20 (e.g., with stitching, adhesive bonding, or heat bonding) and extends through each of regions 11-13 and between sides 14 and 15. A variety of materials may be utilized for midsole 45, including a polymer foam material, such as polyurethane or ethylvinylacetate, that attenuates ground reaction forces as sole structure 30 is compressed between the foot and the ground. As depicted in FIGS. 1-11, a first layer 40 of the midsole 45 is formed of a unitary (i.e., one piece) construction from a single element of the polymer foam material that extends from upper 20 to the second layer 44 of the midsole 45. As a unitary element, first midsole layer 40 may be formed from two densities of the polymer foam material. For example, a rear-lateral area of first midsole layer 40 may be formed from polymer foam material with a greater compressibility than a remainder of midsole 45.

In some embodiments, one or more portions of midsole 45 may include various flexible, semi-rigid, or rigid materials, including, but not limited to various types of plastic, metal, and carbon fiber materials. In one embodiment, first midsole layer 40 may comprise a plate, including a flexible, semi-rigid, or rigid plate formed from a thermal polyurethane ("TPU") thermoplastic material. In other embodiments, the plate may be formed from any suitable materials. By providing first midsole layer 40 as a plate with varying levels of rigidity determined by geometry and/or choice of materials, additional support and stiffness may be provided to midsole 45.

Outsole 50 is secured to a lower area of second midsole layer 44 and forms a ground-engaging surface of footwear 10 that may include texturing to improve traction. In addition to midsole 45 and outsole 50, sole structure 30 may also include a variety of additional footwear elements, including plates, moderators, fluid-filled chambers, lasting elements, or motion control members, that enhance the performance of footwear 10. In some configurations, any of these additional footwear elements may be between midsole 45 and either of upper 20 and outsole 50, embedded within midsole 45, or encapsulated by the polymer foam material of midsole 45, for example. Midsole 45 includes an upper surface 41, an opposite lower surface 42, and a sidewall surface that extends between surfaces 41 and 42. Midsole 45 is interposed between the upper 20 and the outsole 50.

Figure 3:
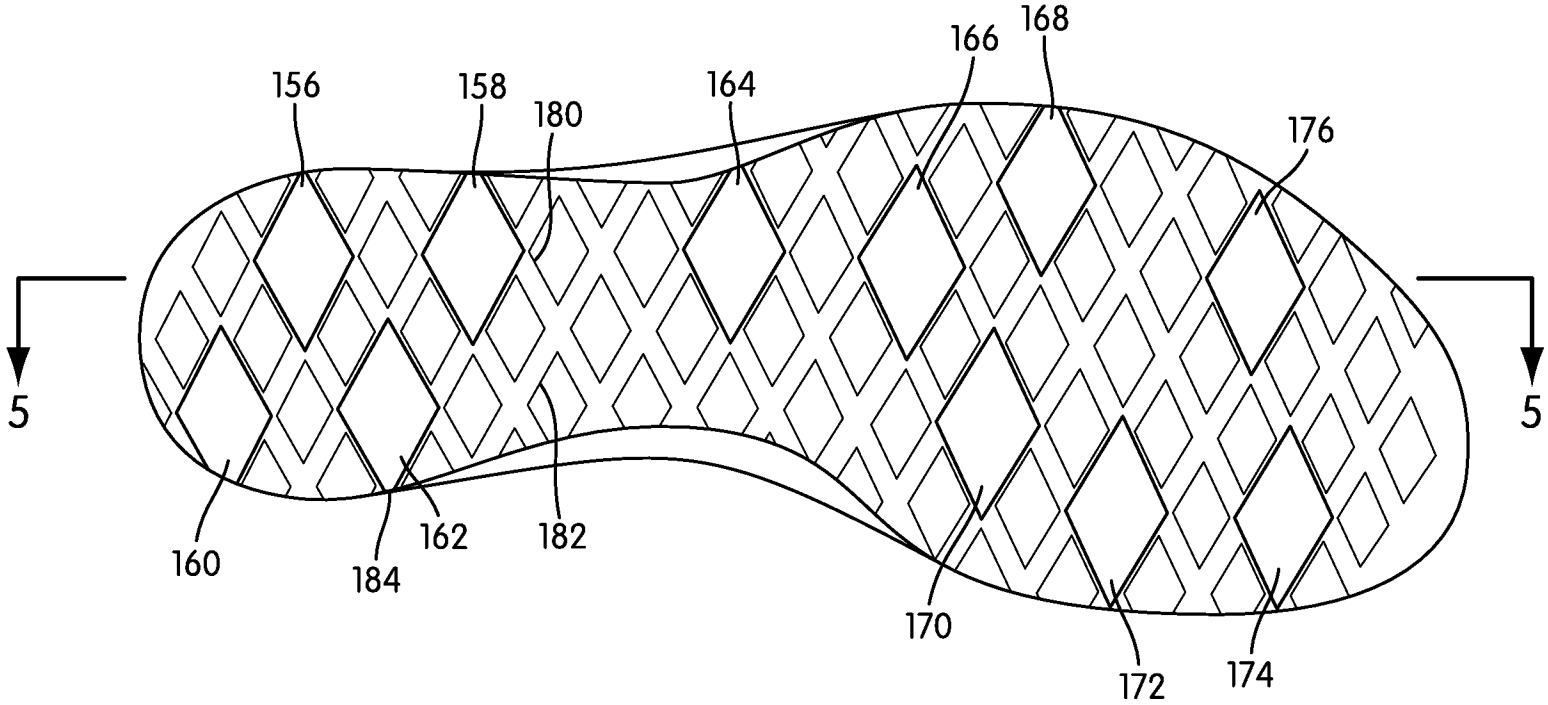
FIG. 3 is a plan view of a first embodiment of the sole structure of the article of footwear.
Figure 4:
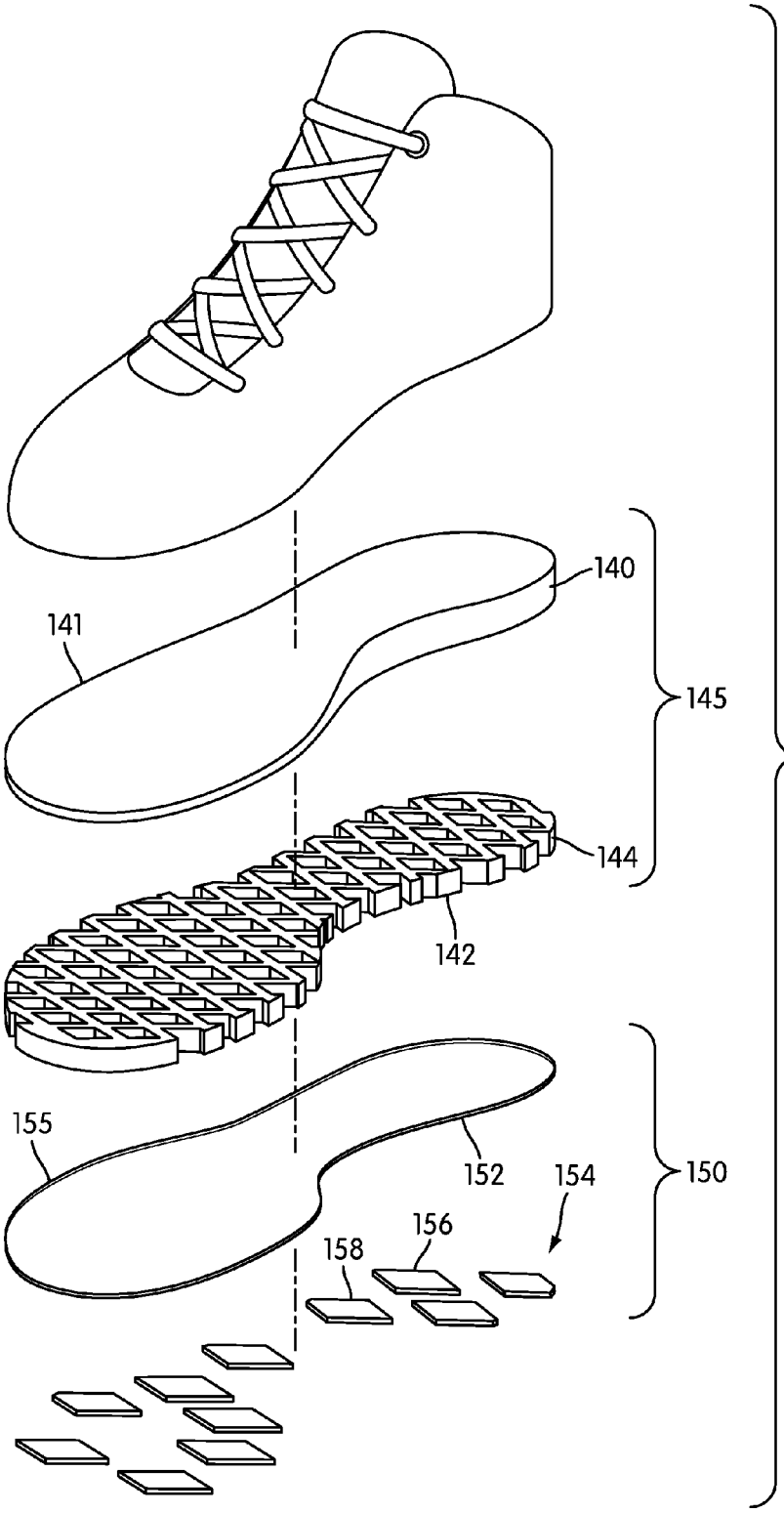
FIG. 4 is an exploded view of the embodiment of the sole structure of FIG. 3.
Figure 5:
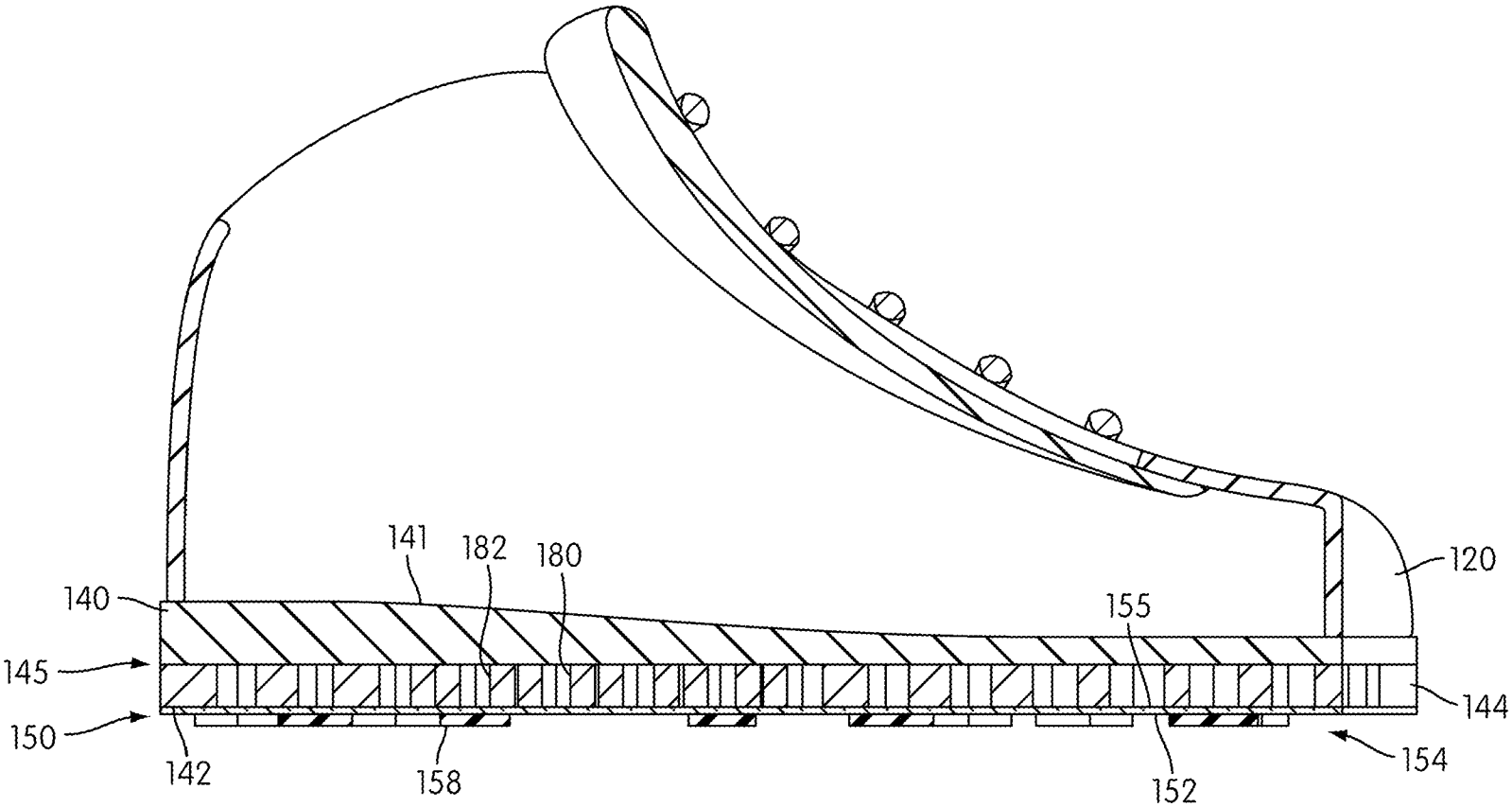
FIG. 5 is a cross-sectional view of the embodiment of the sole structure of FIG. 3 taken along line 5-5.

Turning to FIGS. 3-5, a first embodiment of the midsole and outsole is shown. The midsole 145 may include a first midsole layer 140 and a second midsole layer 144. The upper surface 141 of the first midsole layer 140 may be adjacent and attached to the upper 120 in any conventional manner, such as by stitching, adhesive, or other method appropriate for the materials of the first midsole layer 140 and the upper 120. The lower surface 142 of the second midsole layer 144 may be adjacent and attached to the outsole 150. Thus, the midsole 145 may be interposed between and attached to both the upper 120 and the outsole 150. Both the first midsole layer 140 and the second midsole layer 144 may be formed from polymer foam, and may be formed from ethylvinylacetate foam or polyurethane foam, or a combination thereof. In other embodiments, first midsole layer 140 may be a plate, including a plate formed from TPU, as discussed above, or any other suitable materials. First midsole layer 140 and second midsole layer 144 may also be secured to one another in any conventional manner.

The outsole 150 may include a first outsole layer 152 and a second outsole layer 154. A top surface 155 of the first outsole layer 152 may be adjacent and attached to the lower surface 142 of the second midsole layer 144. The first outsole layer 152 may be formed from a sheet of substantially translucent material, which may be thermoplastic urethane, polyurethane or rubber. The first outsole layer 152 may be formed from a sheet of substantially transparent material. The second outsole layer 154 may include a plurality of non-contiguous, abrasion-resistant members 156, 158, 160, 162, 164, 166, 168, 170, 172, 174, 176. The material chosen for the second outsole layer 154 may be any of a variety of materials that may provide sufficient abrasion resistance to prevent deterioration of the midsole by wearing of the outsole prematurely.

The second midsole layer 144 may include a plurality of bores, such as bore 180. As shown in FIGS. 3-5, bore 180 may be a diamond shape. As also shown in FIGS. 3-5, many of the bores in the second midsole layer 144 may have a diamond shape. However, some bores, such as bore 182, may have a different shape. In the case of bore 182 and similar bores, the bore shape along a peripheral edge 184 of the second midsole layer 144 may differ because the peripheral edge 184 of the second midsole layer 144 is not dependent on the shape of the bore 182. Instead, the bore shape 182 is a truncated form of a diamond and may be triangular. While the shape, size, and pattern of bores 180 in the second midsole layer 144 may be generally regular, in another circumstance, it may be desirable to have bores of varying shape and size in different areas of the second midsole layer 144. For example, in FIGS. 10 and 11, there are shown bores 1080 and 1180 in second midsole layers 1044 and 1144, respectively. Bore 1080 may be octagonal and bore 1180 may be square. Either of these shapes, or indeed any other shape, could be used in the second midsole layer 144 either alone or in combination with other shapes.

The configuration of the second outsole layer 154 may be dependent on the configuration of the second midsole layer 144. Because first outsole layer 152 may be translucent, a user looking at the article of footwear from its lower surface may be able to look through the first outsole layer 152 and see the bores 180 in the second midsole layer 144. Accordingly, the abrasion-resistant members of the second outsole layer 154 may be sized and positioned to correspond in shape and size to at least one of the plurality of bores 180 in the second midsole layer. As may be seen most clearly in FIGS. 3 and 5, abrasion-resistant member 158, for example, may have a diamond shape that may correspond to the diamond shape of bore 182. An abrasion-resistant member corresponds in shape and size to a corresponding bore when it follows a foam strip that forms a dividing line between bores and does not bisect or otherwise only partially cover a corresponding bore in the second midsole layer 144. Each of the other abrasion-resistant members in the second outsole layer 154 may similarly correspond in shape and size to one of the bores in the second midsole layer. Looking also, for example, at abrasion-resistant member 160, the shape of the abrasion-resistant member may be altered based on the intersection of the abrasion-resistant member with the peripheral edge 184 of the outsole 150. However, in such a case, the shape and size of the abrasion-resistant member 160 may still correspond to the shape and size of the corresponding bore in the second midsole layer 144.

The configuration of the abrasion-resistant members on the second outsole layer 154 may be variable. In the embodiment shown in FIGS. 3-5, abrasion-resistant members 156, 158, 160, and 162 may be non-contiguous and may be positioned generally in a heel area. Abrasion-resistant member 164 may be non-contiguous with any other abrasion-resistant member and may be positioned generally in a midfoot area. Abrasion-resistant members 166, 168, 170, 172, 174, and 176 may be non-contiguous and positioned generally in a forefoot area. The precise location and spacing of the abrasion resistant members may be dependent, for example, on purpose to which the footwear is likely to be put to use, the size of the article of footwear, the desired durability, cost, and aesthetic considerations, among other factors.

Other features may also be used in this embodiment. It may be desirable to select material having a first color for the first midsole layer 140 and a material of a different color for the second midsole layer 144. The use of materials of two different colors may allow a user to more clearly see the shape and size of the bores 180 in the second midsole layer 144. It may also be desirable for similar reasons for the second midsole layer 144 to be lighter in color than the first midsole layer 140.

Figure 6:
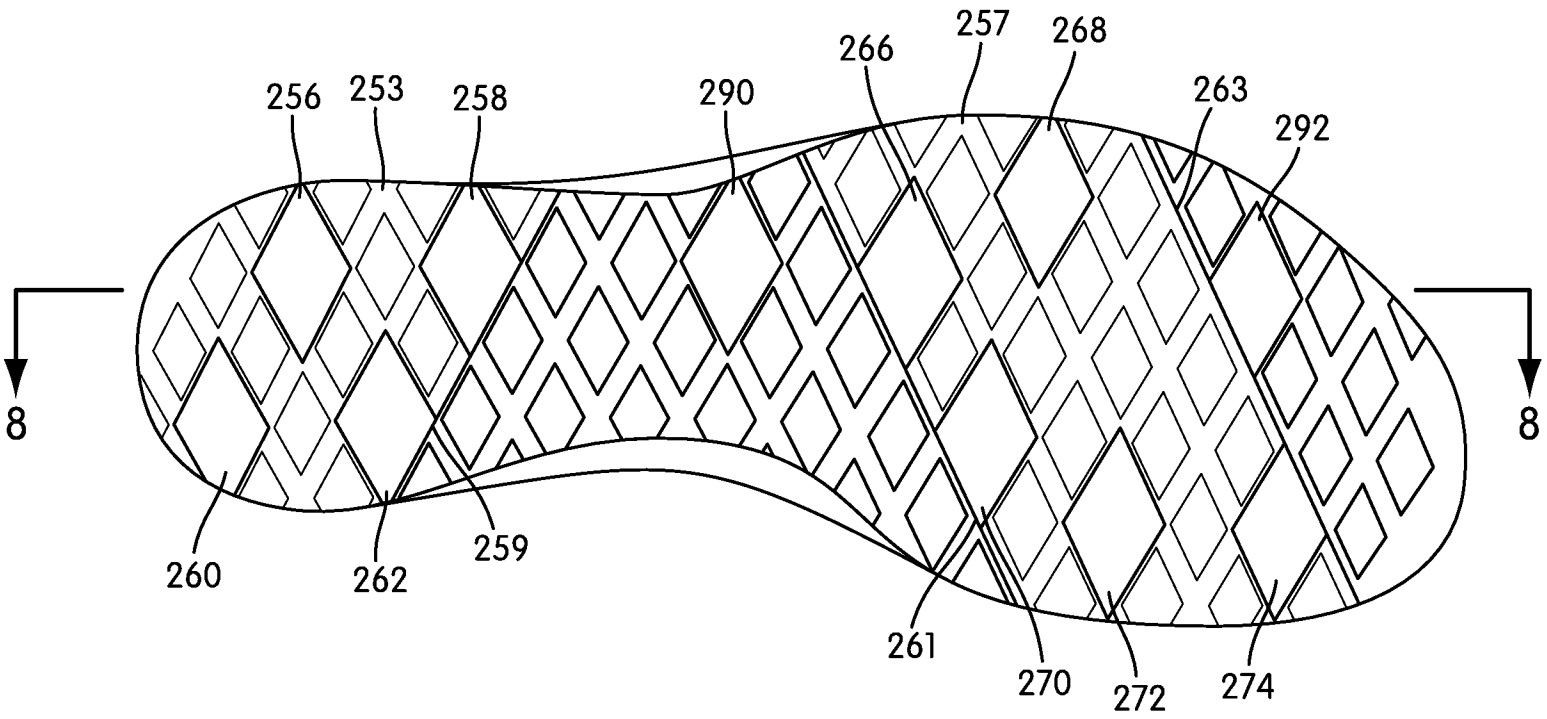
FIG. 6 is a plan view of a second embodiment of the sole structure of the article of footwear.
Figure 7:
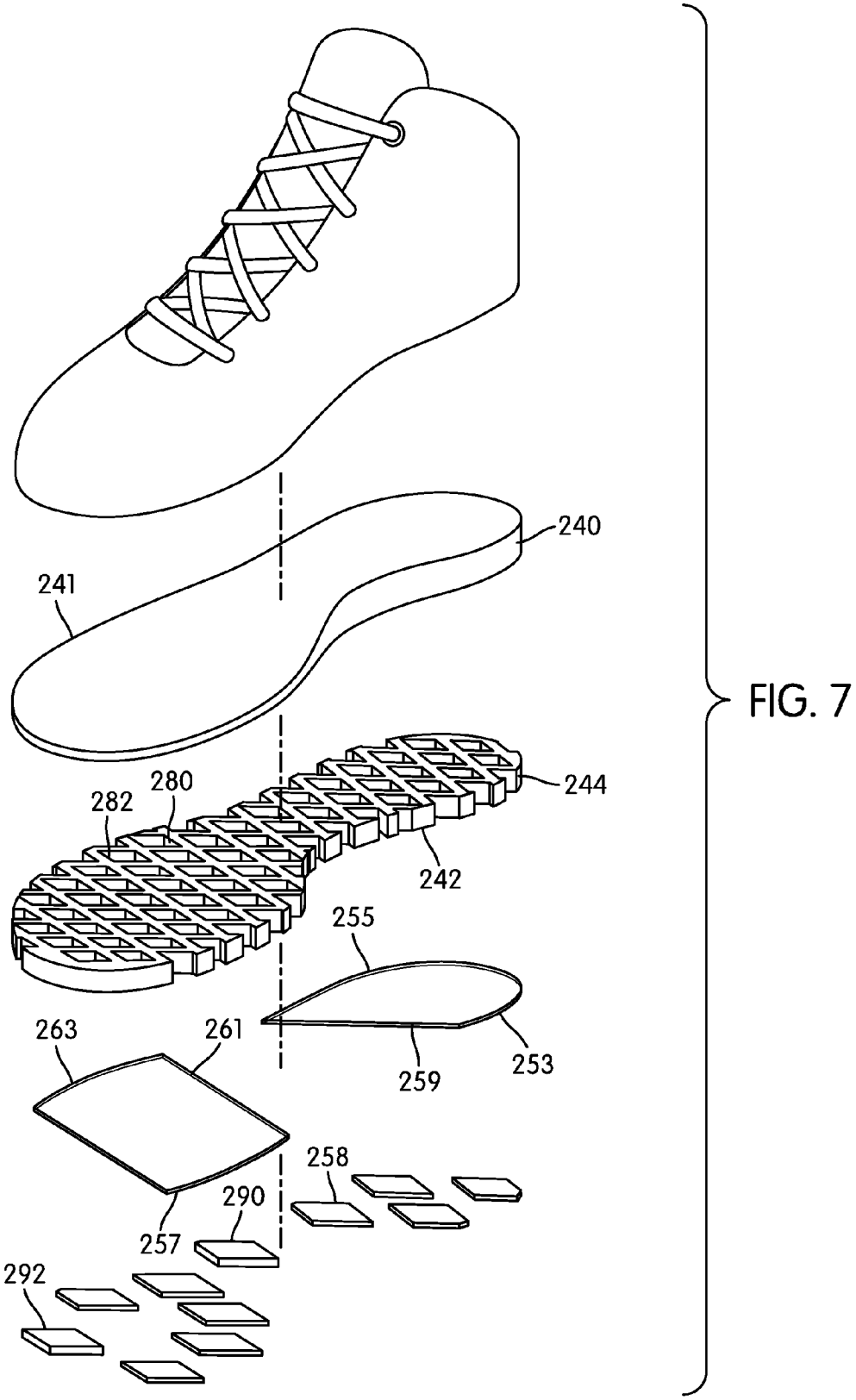
FIG. 7 is an exploded view of the embodiment of the sole structure of FIG. 6.
Figure 8:
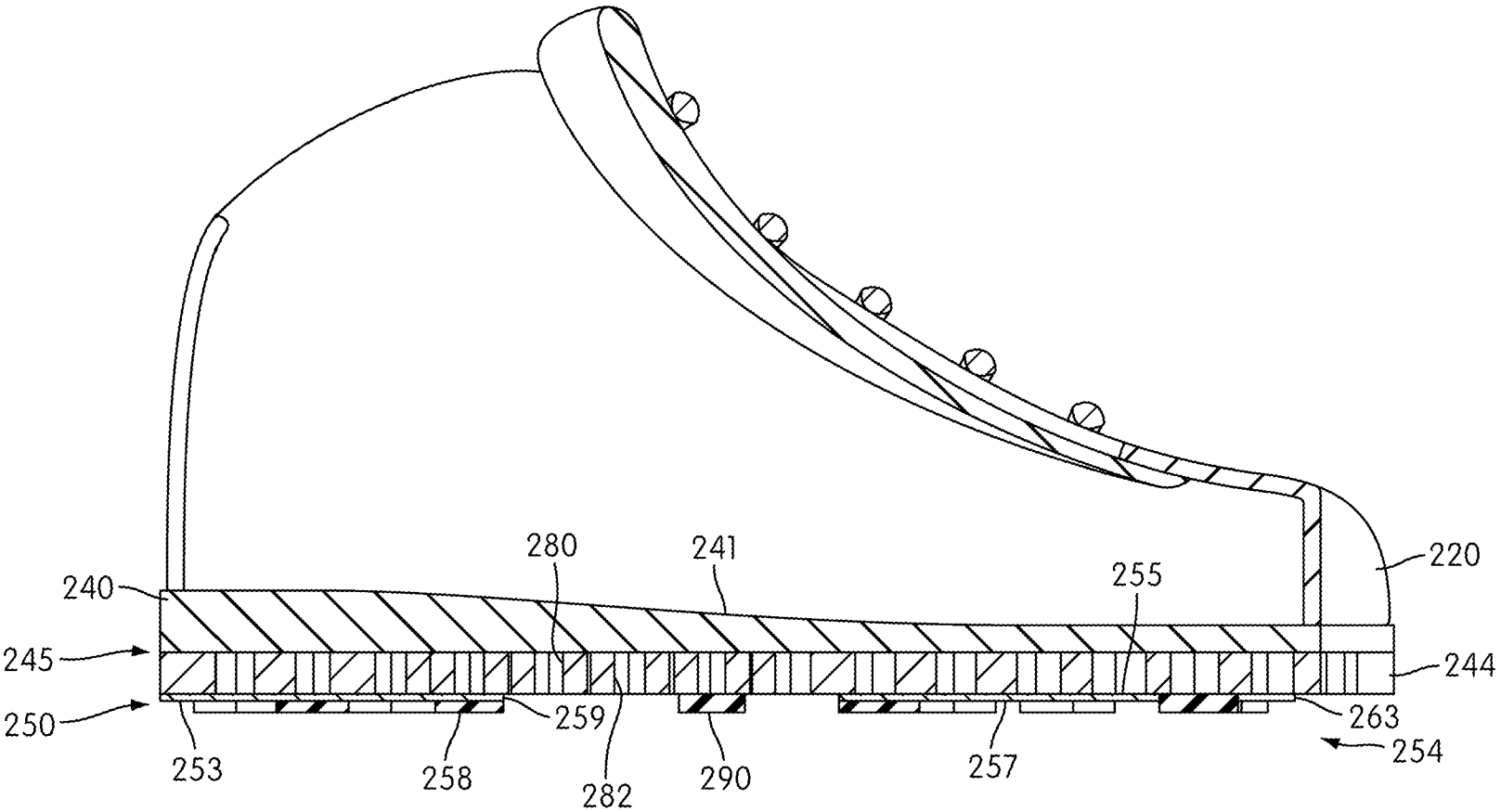
FIG. 8 is a cross-sectional view of the embodiment of the sole structure of FIG. 6 taken along line 8-8.

Turning to FIGS. 6-8, a second embodiment of the midsole and outsole is shown. The midsole 245 may include a first midsole layer 240 and a second midsole layer 244. The upper surface 241 of the first midsole layer 240 may be adjacent and attached to the upper 220 in any conventional manner, such as by stitching, adhesive, or other method appropriate for the materials of the first midsole layer 240 and the upper 220. The lower surface 242 of the second midsole layer 244 may be adjacent and attached to the outsole 250. Thus, the midsole 245 may be interposed between and attached to both the upper 220 and the outsole 250. Both the first midsole layer 240 and the second midsole layer 244 may be formed from polymer foam, and may be formed from ethylvinylacetate foam or polyurethane foam, or a combination thereof. In other embodiments, first midsole layer 240 may be a plate, including a plate formed from TPU, as discussed above, or any other suitable materials. First midsole layer 240 and second midsole layer 244 may also be secured to one another in any conventional manner.

The outsole 250 may include a first outsole layer 252 and a second outsole layer 254. A top surface 255 of the first outsole layer 252 may be adjacent and attached to the lower surface 242 of the second midsole layer 244. The first outsole layer 252 includes at least two non-contiguous sections 253, 257. The first outsole layer 252 may be formed from sheets of translucent material, which may be thermoplastic urethane, polyurethane or rubber. The first outsole layer 252 may be formed from sheets of substantially transparent material. The second outsole layer 254 may include a plurality of non-contiguous, abrasion-resistant members 256, 258, 260, 262, 266, 268, 270, 272, 274, 290, 292. The material chosen for the second outsole layer 254 may be any of a variety of materials that may provide sufficient abrasion resistance to prevent deterioration of the midsole by wearing of the outsole prematurely.

The second midsole layer 244 may include a plurality of bores, such as bore 280. As shown in FIGS. 6-8, bore 280 may be a diamond shape. As also shown in FIGS. 6-8, many of the bores in the second midsole layer 244 may have a diamond shape. However, some bores, such as bore 282, may have a different shape. In the case of bore 282 and similar bores, the bore shape along a peripheral edge 284 of the second midsole layer 244 may differ because the peripheral edge 284 of the second midsole layer 244 is not dependent on the shape of the bore 282. Instead, the bore shape 282 is a truncated form of a diamond and may be triangular. While the shape, size, and pattern of bores 280 in the second midsole layer 244 may be generally regular, in another circumstance, it may be desirable to have bores of varying shape and size in different areas of the second midsole layer 244. For example, in FIGS. 10 and 11, there are shown bores 1080 and 1180 in second midsole layers 1044 and 1144, respectively. Bore 1080 may be octagonal and bore 1180 may be square. Either of these shapes, or indeed any other shape, could be used in the second midsole layer 244 either alone or in combination with other shapes.

The configuration of the first outsole layer 252 may be related to the configuration of the bores 280 in the second midsole layer 244. The first outsole layer 252 may include two non-contiguous sections 253, 257. The first non-contiguous section 253 may correspond generally to the shape and size of a first subset of the plurality of bores 280 in the second midsole layer 244. An outsole layer section 253, 257 corresponds in shape and size to a corresponding subset of bores when it follows a foam strip that forms a dividing line between bores and does not bisect or otherwise only partially cover a corresponding bore in the second midsole layer 244. An edge 259 of the first outsole first section 253 may follow along a dividing line between the bores 280, rather than bisecting or otherwise partially covering a particular bore 280. The second non-contiguous section 257 may correspond generally to the shape and size of a second subset of the plurality of bores 280 in the second midsole layer 244. Edges 261, 263 of the first outsole second section 257 may follow along respective dividing lines between the bores 280, rather than bisecting or otherwise partially covering a particular bore 280. The non-contiguous sections 253, 257 are designed to expose a portion of the midfoot region of the second midsole layer 244 to the ground. Depending on the precise configuration of the first and second sections 253, 257, a portion of the forefoot or the heel regions or both of the second midsole layer 244 may also be exposed to the ground. The embodiment of FIGS. 6-8 shows a portion of the forefoot region being exposed to the ground. In addition, edges 259, 261, and 263 are shown as being straight edges. These edges need not be straight. Instead, they may take another configuration as long as they conform to the shape and size of the bores 280, rather than bisecting or only partially covering any particular bore 280.

The configuration of the second outsole layer 254 may also be dependent on the configuration of the second midsole layer 244. Because first outsole layer 252 may be translucent and does not cover the entire lower surface 242 of the second midsole layer 244, a user looking at the article of footwear from its lower surface may be able to look through the first outsole layer 252 and see the bores 280 in the second midsole layer 244. Accordingly, the abrasion-resistant members of the second outsole layer 254 may be sized and positioned to correspond in shape and size to at least one of the plurality of bores 280 in the second midsole layer. An abrasion-resistant member corresponds in shape and size to a corresponding bore when it follows a foam strip that forms a dividing line between bores and does not bisect or otherwise only partially cover a corresponding bore in the second midsole layer 244. As may be seen most clearly in FIGS. 6 and 8, abrasion-resistant member 258 may have a diamond shape that may correspond to the diamond shape of bore 282. Each of the other abrasion-resistant members in the second outsole layer 254 may similarly correspond in shape and size to one of the bores in the second midsole layer. Looking also, for example, at abrasion-resistant member 260, the shape of the abrasion-resistant member may be altered based on the intersection of the abrasion-resistant member with the peripheral edge 284 of the outsole 250. However, in such a case, the shape and size of the abrasion-resistant member 260 may still correspond to the shape and size of the corresponding bore in the second midsole layer 244.

In other areas on the outsole 250, the abrasion-resistant members on the second outsole layer 254 may not be intermediately attached to the first outsole layer 252. For example, abrasion-resistant member 290 may be positioned in a midfoot region. Abrasion-resistant member 290 may be attached to the midfoot region of the second midsole layer 244 that may be exposed between the first section 253 and second section 257 of the first outsole layer 252. Similarly, abrasion-resistant member 292 may be attached in a forefoot region of the second midsole layer that may be exposed to the ground and not covered by the first outsole layer 252. In such instances, the thickness of the abrasion-resistant members 290, 292 that may be attached directly to the second midsole layer 244 may have a thickness that may be the same as the combined thickness of the first outsole layer 252 and the other abrasion resistant members in the second outsole layer 254. This correspondence in thickness may create a consistent impact with the ground across the sole.

The configuration of the abrasion-resistant members on the second outsole layer 254 may be variable. In the embodiment shown in FIGS. 6-8, abrasion-resistant members 256, 258, 260, and 262 may be non-contiguous and may be positioned generally in a heel area. Abrasion-resistant member 290 may be non-contiguous with any other abrasion-resistant member and may be positioned generally in a midfoot area. Abrasion-resistant members 266, 268, 270, 272, 274, and 292 may be non-contiguous and positioned generally in a forefoot area. The precise location and spacing of the abrasion resistant members may be dependent, for example, on purpose to which the footwear is likely to be put to use, the size of the article of footwear, the desired durability, cost, and aesthetic considerations, among other factors. At least one abrasion-resistant member may be secured to each of the sections 253, 257 of the first outsole layer 252.

Other features may also be used in this embodiment. It may be desirable to select material having a first color for the first midsole layer 240 and a material of a different color for the second midsole layer 244. The use of materials of two different colors may allow a user to more clearly see the shape and size of the bores 280 in the second midsole layer. It may also be desirable for similar reasons for the second midsole layer 244 to be lighter in color than the first midsole layer 240.

Figure 9:
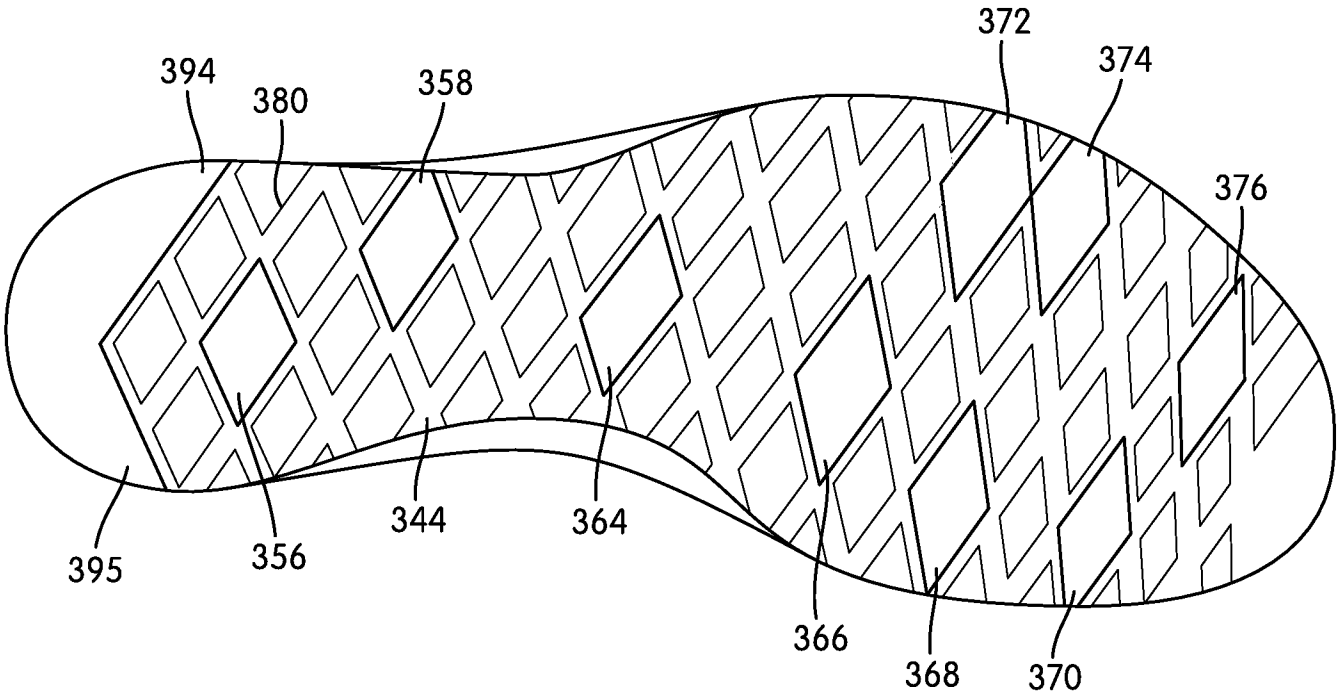
FIG. 9 is a plan view of a third embodiment of the sole structure of the article of footwear.

Another alternative embodiment is shown in FIG. 9. The configuration of the second outsole layer 354 in the embodiment of FIG. 9 may be understood to be able to be used with either the first or second embodiment as described above or a combination thereof. The only substantial distinction may be in the configuration of the abrasion-resistant members.

The second outsole layer 354 may include a heel strike abrasion resistant member 394. Heel strike abrasion resistant member 394 may cover more than one bore 380 in the second midsole layer 344 but may correspond generally in shape and size to the bores 380 in that it does not bisect or otherwise partially cover any one bore 380. Instead, the edge 395 of the abrasion resistant member 394 may follow the dividing line between various bores 380. An abrasion-resistant member corresponds in shape and size to a corresponding bore when it follows a foam strip that forms a dividing line between bores and does not bisect or otherwise only partially cover a corresponding bore in the second midsole layer 344. Looking to the remaining abrasion resistant members in this embodiment, the abrasion resistant members may conform generally to the impact-absorbing portion of a foot placed in the footwear. The abrasion resistant members in the forefoot region 366, 368, 370, 372, 374, 376 may generally follow the outline of a forefoot of a foot. Abrasion resistant members 356, 358, 394 may generally follow the outline of a heel of a foot. Abrasion resistant member 364 in the midfoot region may correspond generally to a midfoot of a foot. Positioning the abrasion resistant members in such a configuration may allow for improved durability of the outsole 350.

Figure 10:
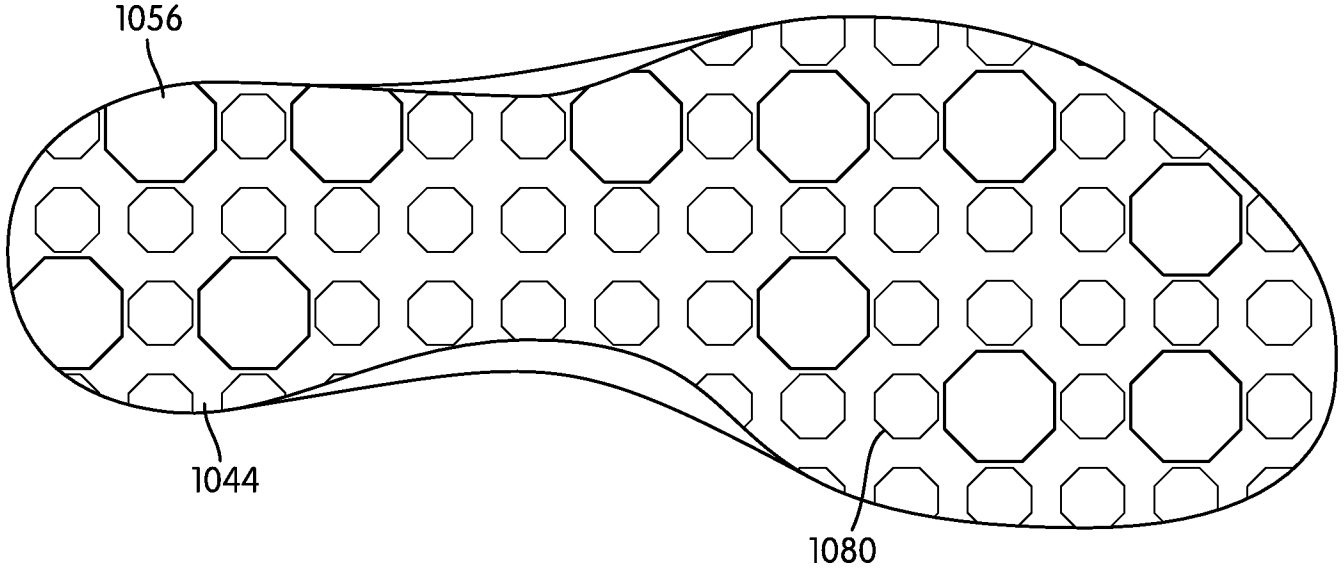
FIG. 10 is a partial plan view of a fourth embodiment of the sole structure of the article of footwear.
Figure 11:
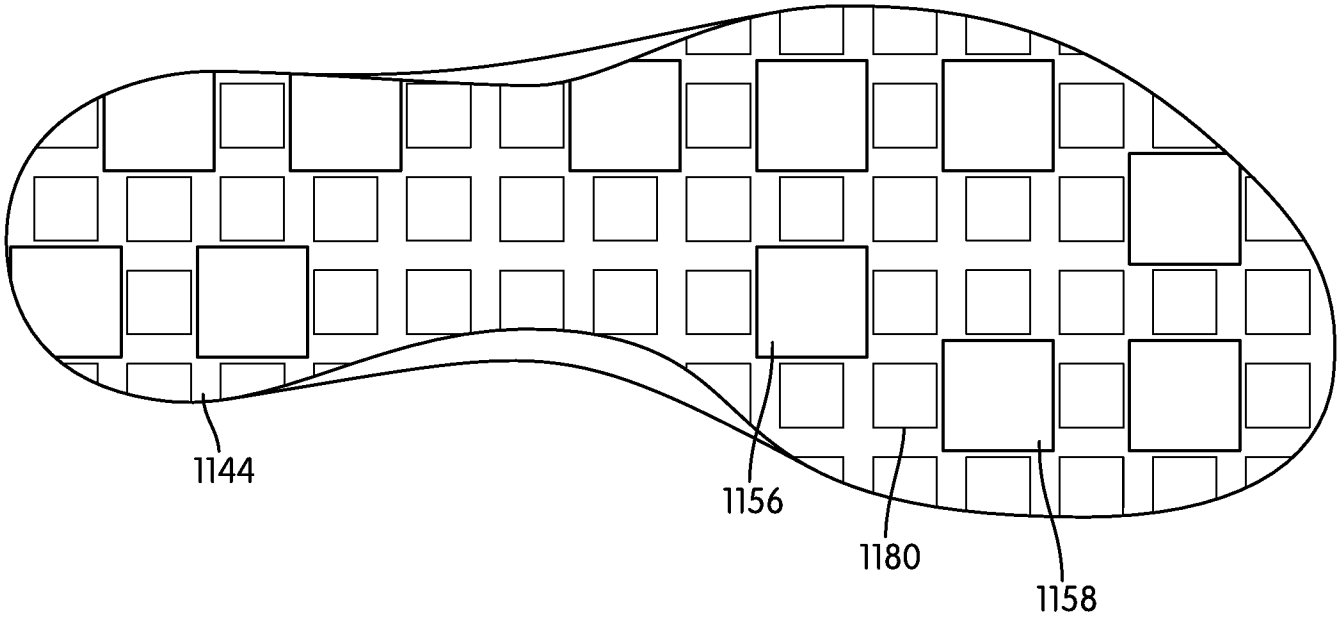
FIG. 11 is a partial plan view of a fifth embodiment of the sole structure of the article of footwear.

FIGS. 10 and 11 show partial plan views of alternative configurations of the sole structure. FIG. 10 shows octagonal bores 1080 in a second midsole layer 1044. An abrasion-resistant member 1056 corresponds in shape and size to the bore in the second midsole layer 1044. FIG. 11 shows square bores 1180 in second midsole layer 1144. Non-contiguous abrasion resistant members 1156 and 1158 each correspond in shape and size to a respective bore in the second midsole layer. Other shapes could be used for the bores and abrasion resistant members, such as circles, triangles, hexagons, or the like. Indeed several different shapes could be used in one sole structure. The precise shape used and its size are not critical.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an upper;

an outsole; and a midsole interposed between and attached to both the upper and the outsole, wherein the midsole comprises a first midsole layer and a second midsole layer secured to one another, the first midsole layer being adjacent the upper and the second midsole layer being adjacent the outsole, the second midsole layer defining a plurality of bores, each bore having a shape, the plurality of bores including a first bore and a second bore, the first bore being completely surrounded by a first dividing strip, the second bore being completely surrounded by a second dividing strip; and the outsole comprises a first outsole layer and a second outsole layer, the first outsole layer being adjacent the midsole and being substantially translucent and the second outsole layer comprising at least two non-contiguous, abrasion-resistant members;

wherein the at least two abrasion-resistant members comprise a first abrasion-resistant member and a second abrasion-resistant member;

the first abrasion-resistant member corresponding in shape and size to the first bore, the first abrasion-resistant member following the first dividing strip surrounding the first bore, the first abrasion-resistant member substantially covering the first bore, the second abrasion-resistant member corresponding in shape and size to the second bore, the second abrasion-resistant member following the second dividing strip surrounding the second bore, the second abrasion-resistant member substantially covering the second bore;

wherein the first abrasion-resistant member is spaced from the second abrasion-resistant member in a non-contiguous arrangement, wherein the first dividing strip is completely surrounded by a first set of surrounding bores, wherein the first abrasion-resistant member is bounded by the first dividing strip and ends at the first dividing strip so that all of the first set of surrounding bores remains exposed and uncovered by the first abrasion-resistant member; and wherein the substantially translucent layer covers the first set of surrounding bores.

2. The article of footwear according to claim 1, wherein the first outsole layer extends over a portion of the midsole, at least the first bore being secured to the first outsole layer and at least the second bore being secured to the midsole.

3. The article of footwear according to claim 1, wherein the article further comprises a third bore and a third abrasion-resistant member, the third bore consisting of a shape, the third abrasion-resistant member consisting of a shape that corresponds to the shape of the third bore such that the third abrasion-resistant member covers the third bore.

4. The article of footwear according to claim 1, wherein the second midsole layer includes a peripheral edge, the first abrasion-resistant member being spaced from the peripheral edge.

5. The article of footwear according to claim 1, wherein the first and second midsole layers are formed from foam.

6. The article of footwear according to claim 1, wherein the substantially translucent layer is visible and exposed in an area between the first abrasion-resistant member and the second abrasion-resistant member.

7. An article of footwear comprising:

an upper;

an outsole; and a midsole interposed between and attached to both the upper and the outsole, wherein the midsole comprises a first midsole layer and a second midsole layer secured to one another, the first midsole layer being adjacent the upper and the second midsole layer being adjacent the outsole, the second midsole layer including a peripheral edge, the peripheral edge extending completely around the second midsole layer, the second midsole layer defining a plurality of bores, each bore having a shape; and the outsole comprises a first outsole layer and a second outsole layer, the first outsole layer being adjacent the midsole and being substantially translucent and comprising at least two non-contiguous sections that correspond generally in shape and size to first and second subsets of the plurality of bores in the second midsole layer, the second outsole layer comprising at least two non-contiguous, abrasion-resistant members;

wherein the at least two abrasion-resistant members comprise a first abrasion-resistant member and a second abrasion-resistant member;

the first abrasion-resistant member having a first peripheral edge that extends completely around the first abrasion-resistant member;

the first abrasion-resistant member corresponding in shape and size to a first bore, the first abrasion-resistant member substantially covering the first bore, the second abrasion-resistant member corresponding in shape and size to a second bore, the second abrasion-resistant member substantially covering the second bore, at least the first abrasion-resistant member being spaced from the peripheral edge such that the first peripheral edge is spaced from the peripheral edge of the second midsole layer;

wherein the second midsole layer is visible and exposed in an area between the first abrasion-resistant member and the second abrasion-resistant member; and wherein the first bore is completely surrounded by a first dividing strip, the second bore is completely surrounded by a second dividing strip, the first abrasion-resistant member following the first dividing strip surrounding the first bore, and the second abrasion-resistant member following the second dividing strip surrounding the second bore.

8. The article of footwear according to claim 7, wherein the two non-contiguous sections of the first outsole layer expose a midfoot region of the second midsole layer.

9. The article of footwear according to claim 8, wherein a third abrasion-resistant member is attached to the exposed region of the second midsole layer.

10. The article of footwear according to claim 9, wherein a third bore is surrounded by a third dividing strip, the third abrasion-resistant member following the third dividing strip surrounding the third bore.

11. The article of footwear according to claim 10, wherein the third abrasion-resistant member attached to the second midsole layer is thicker than the first abrasion-resistant member and the second abrasion-resistant member.

12. The article of footwear according to claim 10, wherein the first section corresponds to a forefoot region of a foot.

13. The article of footwear according to claim 10, wherein the second section corresponds to a heel region of a foot.

14. The article of footwear according to claim 7, wherein the bores are diamond shaped.

15. An article of footwear comprising:

an upper;

an outsole; and a midsole interposed between and attached to both the upper and the outsole, wherein the midsole comprises a first midsole layer and a second midsole layer secured to one another, the first midsole layer being adjacent the upper and the second midsole layer being adjacent the outsole, the second midsole layer defining a plurality of bores, each bore having a shape; and the outsole comprises a first outsole layer and a second outsole layer, the first outsole layer being adjacent the midsole, the first outsole layer extending over a portion of the midsole, the first outsole layer having at least a portion which is substantially transparent and the second outsole layer comprising a plurality of non-contiguous, abrasion-resistant members, wherein the plurality of abrasion-resistant members comprises a forefoot group and a midfoot group;

wherein the forefoot group comprises at least one first abrasion-resistant member that corresponds in shape and size to a first bore, the at least one first abrasion-resistant member substantially covering the first bore, the at least one first abrasion-resistant member being secured to the first outsole layer, the midfoot group comprises at least one second abrasion-resistant member that corresponds in shape and size to a second bore, the at least one second abrasion-resistant member substantially covering the second bore, the at least one second abrasion-resistant member being secured to the second midsole layer;

wherein the forefoot group comprises a greater number of abrasion-resistant members than the midfoot group; and wherein the first bore is completely surrounded by a first dividing strip and the second bore is completely surrounded by a second dividing strip, the first abrasion-resistant member following the first dividing strip surrounding the first bore, the second abrasion-resistant member following the second dividing strip surrounding the second bore.

16. The article of footwear according to claim 15, wherein the plurality of abrasion-resistant members further comprises a heel group, the heel group comprising at least one third abrasion-resistant member that corresponds in shape and size to a third bore, the at least one third abrasion-resistant member substantially covering the third bore.

17. The article of footwear according to claim 15, wherein the second midsole layer is visible and exposed in a space between the at least one first abrasion-resistant member and the at least one second abrasion-resistant member.

18. The article of footwear according to claim 15, wherein the at least one first abrasion-resistant member is spaced from the at least second abrasion resistant member.

19. The article of footwear according to claim 15, wherein the first and second midsole layers are formed from foam.

20. The article of footwear according to claim 15, wherein the second midsole layer includes a peripheral edge, the first abrasion-resistant member being spaced from the peripheral edge.

* * * * *